US007611079B2

(12) United States Patent
Whittaker et al.

(10) Patent No.: US 7,611,079 B2
(45) Date of Patent: Nov. 3, 2009

(54) SPRAY NOZZLE

(75) Inventors: Frank Whittaker, Warrington (GB); James E. Lloyd, Warrington (GB); David R. Percival, Warrington (GB)

(73) Assignee: Delavan Limited, Cheshire (GB)

( * ) Notice: Subject to any disclaimer, the term of this patent is extended or adjusted under 35 U.S.C. 154(b) by 175 days.

(21) Appl. No.: 11/580,179

(22) Filed: Oct. 12, 2006

(65) Prior Publication Data

US 2007/0235564 A1 Oct. 11, 2007

(51) Int. Cl.
*B05B 1/32* (2006.01)
*B05B 1/34* (2006.01)

(52) U.S. Cl. ..... 239/457; 239/483; 239/492; 239/490; 239/491; 239/496; 239/463; 239/468; 239/548

(58) Field of Classification Search ..... 239/451, 239/468, 590.3, 490, 505, 333, 332, 548, 239/399, 483, 492, 463, 491, 496
See application file for complete search history.

(56) References Cited

U.S. PATENT DOCUMENTS

| | | | | |
|---|---|---|---|---|
| 1,183,393 | A * | 5/1916 | Merrell | 239/493 |
| 2,378,348 | A * | 6/1945 | Wilmes et al. | 239/491 |
| 2,921,747 | A | 1/1960 | Burman | |
| 3,304,013 | A * | 2/1967 | O'Brien | 239/468 |
| 3,441,223 | A * | 4/1969 | Lapera | 239/403 |
| 3,680,793 | A | 8/1972 | Tate et al. | |
| 4,079,762 | A * | 3/1978 | Hanson, Jr. | 141/286 |
| 4,103,830 | A | 8/1978 | Roth | |
| 4,258,885 | A * | 3/1981 | Legeza | 239/707 |
| 4,307,840 | A * | 12/1981 | Schulze et al. | 239/451 |
| 4,618,101 | A | 10/1986 | Piggott | |
| 4,736,893 | A * | 4/1988 | Norskov | 239/590.3 |
| 5,934,569 | A * | 8/1999 | Soule et al. | 239/468 |
| 6,193,172 | B1 * | 2/2001 | Soule et al. | 239/468 |

FOREIGN PATENT DOCUMENTS

| | | |
|---|---|---|
| EP | 0 430 858 A | 6/1991 |
| NZ | 336112 | 2/2001 |
| WO | WO 99/11382 A | 3/1999 |

OTHER PUBLICATIONS

European Search Report dated Jul. 27, 2007.

* cited by examiner

*Primary Examiner*—Len Tran
*Assistant Examiner*—Trevor E McGraw
(74) *Attorney, Agent, or Firm*—Edwards Angell Palmer & Dodge LLP

(57) ABSTRACT

A spray nozzle which employs a locking and an alignment feature to facilitate the replacement of internal nozzle components. The spray nozzle includes a nozzle body, a swirl element and an orifice disc. The nozzle body defines a central bore which extends between a fluid receiving section and a fluid discharge section and delineates a central axis and delimits an interior locating surface for swirl element and the orifice disc. The orifice disc includes a protuberance associated with the downstream surface thereof which protrudes into the spray opening of the nozzle body.

30 Claims, 5 Drawing Sheets

SPRAY NOZZLE

BACKGROUND OF THE INVENTION

1. Field of the Invention

The subject invention relates to spray nozzles for use in spray drying applications, and more particularly to, spray nozzles of the type which employ locating and/or wear part retention/locking features to facilitate ease of replacement and handling of internal nozzle components and the reinstallation of the assembled unit in the nozzle location.

2. Background of the Related Art

Fluid nozzles or atomizers having a spiral swirl chamber and a spray orifice disposed within a nozzle body have been employed in the past for various applications, including spray drying, aeration, cooling, and fuel injection. U.S. Pat. No. 3,680,793 to Tate, which is herein incorporated by reference in its entirety, discloses a spray nozzle that includes a swirl chamber configured such that the origin of the spiral flow in the swirl chamber and the spray orifice formed in the orifice disc are eccentrically offset relative to each other. The spray orifice and the spiral flow origin were eccentrically offset from each other so as to improve the spray patternation in both large and small spray nozzle applications.

Spray drying is the transformation of a feed liquid from a fluid state into dried particulate form by spraying atomized feed into a gaseous drying medium. The liquid feed can be either a solution, suspension, dispersion, emulsion or slip. Often, the liquid feed contains abrasive solids. The atomization of the feed is accomplished by a spray nozzle. The nozzle must disperse the liquid into small droplets, which should be well distributed into the air stream and also serve as the metering device for the feed system.

In applications such as spray drying, the energy for atomization is supplied solely by the liquid feed pressure with inlet pressures typically exceeding 5,000 psi and occasionally reaching 10,000 psi. Due to the high inlet pressure, the liquid feed passes through the flow passages of the spray nozzle at a high velocity. Liquid feed containing abrasive solids and traveling at a high flow velocity causes erosion of the flow passages in the swirl chamber and orifice disc. As a result, the swirl chamber and orifice disc need to be replaced somewhat routinely.

In most nozzles, replacement of the internal components first requires the removal of the nozzle assembly from the fluid delivery system. Then an adapter which is normally threadably secured to the nozzle body must be disengaged. The adapter functions to secure the internal components, namely the swirl chamber, orifice disc and O-ring seals (adapter and orifice), within the nozzle body. The adapter also facilitates the axial alignment of the swirl chamber by providing a recess for the swirl chamber in its down stream end. Next an adapter seal, which is disposed between the adapter and the swirl chamber is removed. At this point, the remainder of the internal components can be freely removed.

Reassembling the spray nozzle is accomplished by reversing the disassembly procedure. However, difficulty is often encountered when attempting to engage the nozzle body, including the orifice disc and associated O-ring, with the adapter. Generally, the adapter is placed on a flat surface and the orifice disc is placed on top within the alignment recess. The nozzle body with orifice disc disposed therein is also placed on a flat surface with the discharge orifice facing down. In order to assemble the nozzle, either the adapter or the nozzle body have to be inverted. However, when inverting either the nozzle body or the adapter to engage the parts, the internal components unseat, become misaligned and often fall out.

There is a need therefore, for a spray nozzle which facilitates replacement of worn internal components by proving a mechanism for aligning and securing the internal components prior to engagement of the adapter with the nozzle body.

SUMMARY OF THE INVENTION

The subject application is directed to a new and improved spray nozzle which includes a nozzle body, a swirl element and an orifice disc. The nozzle body has opposed upstream and downstream end portions. The upstream end portion includes a fluid receiving section and the downstream end portion includes a fluid discharge section and defines a spray opening for emitting an atomized spray therefrom. The nozzle body defines a central bore which extends between the fluid receiving section and the fluid discharge section and delineates a central axis and delimits an interior locating surface for the nozzle.

The swirl element is disposed within the central bore of the nozzle body and is positioned adjacent to the fluid receiving section. The swirl element has a peripheral surface and defines an interior swirl cavity. Preferably, the peripheral surface has an upstream and a downstream portion, the downstream portion being configured for slidable engagement with the locating surface of the nozzle body. The upstream portion has a fluid inlet formed therein to provide a path for fluid to communicate between the fluid receiving section of the nozzle body and the interior swirl cavity of the swirl element.

The interior swirl cavity of the swirl element is defined by an approximately curvilinear surface for imparting a spiral flow to the fluid passing therethrough and includes a fluid outlet for discharging the spiral flow therefrom. Additionally, in a preferred embodiment, the swirl element further includes a recessed surface formed in the upstream portion of the peripheral surface for facilitating fluid flow between the upstream portion of the peripheral surface and the nozzle body. In one embodiment, the recessed surface formed in the peripheral surface of the swirl element has a trapezoidal axial cross-section.

In an alternate embodiment, the swirl element further includes a tapered neck portion associated with an upstream end thereof. The tapered neck portion, by providing a smooth transition, facilitates the communication of fluid between the fluid receiving portion of the nozzle body and fluid inlet of the swirl element. The tapered neck portion also prevents material blockages from forming within the internal flow path and reduces the pressure loss across the nozzle assembly.

The orifice disc is also disposed within the central bore of the nozzle body and is positioned upstream of the fluid discharge section. The orifice disc includes axially opposed upstream and downstream surfaces which define a peripheral surface therebetween. The peripheral surface is configured for slidable engagement with the interior locating surface of the nozzle body.

A spray orifice extends between the opposed upstream and downstream surfaces and is in fluid communication with the fluid outlet of the swirl cavity and the discharge section of the nozzle body. It is presently envisioned that the orifice disc has a protuberance associated with the downstream surface thereof which projects into the spray opening of the nozzle body and prevents the incorrect orientation of the disc. In a preferred embodiment, the protuberance has a chamfered downstream edge which facilitates the insertion of the protuberance into the spray opening of the nozzle body.

It is envisioned that the spray nozzle further includes an adapter member which is engaged with the upstream end portion of the nozzle body so as to contain the orifice disc and swirl element within the bore of the nozzle body. Preferably, the upstream end portion of the nozzle body has male threads associated therewith for engagement with corresponding female threads associated with the adapter member.

Preferably the central bore of the nozzle body further includes a second interior locating surface having two radially opposed recesses formed therein. The second interior surface is positioned radially outward of the interior locating surface so as to facilitate the communication of fluid between the upstream portion of the swirl element peripheral surface and the nozzle body.

In a preferred embodiment, the spray nozzle of the present disclosure further includes a locking plate disposed within the central bore of the nozzle body and positioned upstream of the swirl element. The locking plate is rotatably engaged within radially opposed recesses formed in the central bore of the nozzle body. It is envisioned that the recesses are formed in a plane which passes through the central axis of the nozzle at a right angle. In an alternate embodiment, the recesses are angled with respect to a plane passing through and perpendicular to the central axis. As a result, the rotational engagement of the locking plate with the recesses increases a contact pressure applied by the locking plate to the swirl element. It is presently preferred that the locking plate also includes a tool engaging portion which facilitates the rotational engagement of the locking plate within the recesses.

Alternatively, the spray nozzle disclosed herein can include a retainer element in lieu of the locking plate. The retainer element is also disposed within the central bore of the nozzle body and positioned upstream of the swirl element. The retainer element includes a retainer disc and a seal member. The retainer disc has opposed upstream and downstream planar surfaces and a peripheral surface extending therebetween. A groove formed in the peripheral surface and the seal member is disposed within the groove. The seal member engages with a corresponding recess formed in the central bore of the nozzle body so as to secure the retainer element, swirl element, and orifice disc within the central bore of the nozzle body. In a preferred embodiment, the retainer disc includes flow apertures formed therein which extend between the opposed upstream and downstream planar surfaces. The flow apertures providing for fluid communication between the fluid receiving portion of the nozzle body and the upstream portion of the swirl element peripheral surface.

The present disclosure is also directed to an orifice disc for a spray nozzle which includes a nozzle body. The nozzle body has opposed upstream and downstream end portions. The upstream end portion includes a fluid receiving section and the downstream end portion includes a fluid discharge section and defines a spray opening for emitting an atomized spray therefrom. The nozzle body defines a central bore which extends between the fluid receiving section and the fluid discharge section and delineates a central axis and delimits an interior locating surface for the orifice disc.

The orifice disc includes axially opposed upstream and downstream surfaces which define a peripheral surface therebetween. The peripheral surface is adapted and configured for slidable engagement with the interior locating surface of the nozzle body. The orifice disc further includes a spray orifice that extends between the opposed upstream and downstream surfaces. The downstream surface has a protuberance formed thereon for increasing the axial length of the spray orifice. It is envisioned that the spray orifice of the orifice disc further includes a tapered inlet formed in the upstream surface of the orifice disc so as to centrally direct fluid provided thereto. Preferably, the protuberance has a chamfered downstream edge which facilitates the insertion of the protuberance into the opening of the nozzle body.

The present disclosure is also directed to a spray nozzle which includes a nozzle body, a swirl element, an orifice disc and a locking mechanism. The nozzle body, swirl element and orifice disc being similar to those described for previous embodiment. The locking mechanism is disposed within the central bore of the nozzle body and is positioned upstream of the swirl element. The locking mechanism is dimensioned and configured for engagement with at least one groove formed in the central bore of the nozzle body. In one embodiment, the locking mechanism is provided in the form of a plate member. Alternatively, the locking mechanism includes protrusions formed on the upstream portion of the swirl element peripheral surface which are adapted and configured for engagement with the at least one groove. Also, the locking mechanism can be formed as an independent structural element or can be integral with the swirl element.

In an alternative embodiment, the locking mechanism includes a retainer element disposed within the central bore of the nozzle body which is positioned upstream of the swirl element. The retainer element includes a retainer disc and a seal member. The retainer disc has opposed upstream and downstream planar surfaces and a peripheral surface extending therebetween. A recess is formed in the peripheral surface and the seal member is disposed therein. When the retainer element is disposed within the central bore, the seal member engages with the at least one groove formed in the central bore. It is envisioned that the retainer disc includes flow apertures which extend between the opposed upstream and downstream planar surfaces to provide fluid communicated between the fluid receiving portion of the nozzle body and the upstream portion of the swirl element peripheral surface.

Preferably, the locking mechanism includes a tool engaging portion for facilitating the rotational engagement of the locking mechanism with the recesses formed in the central bore, where such rotational movement is required to remove the locking mechanism.

Those skilled in the art will readily appreciate that the subject invention facilitates the replacement of worn internal nozzle components and the reassembling of the nozzle, whilst ensuring the retention of said internal components during the reinstallation process of the assembled nozzle. These and other unique features of the spray nozzle disclosed herein will become more readily apparent from the following description, the accompanying drawings and the appended claims.

BRIEF DESCRIPTION OF THE DRAWINGS

So that those having ordinary skill in the art to which the subject invention appertains will more readily understand how to make and use the same, reference may be had to the drawings wherein.

These and other features of the subject invention will become more readily apparent to those having ordinary skill in the art from the following detailed description of preferred embodiments.

DETAILED DESCRIPTION OF PREFERRED EMBODIMENTS

Figure 1:
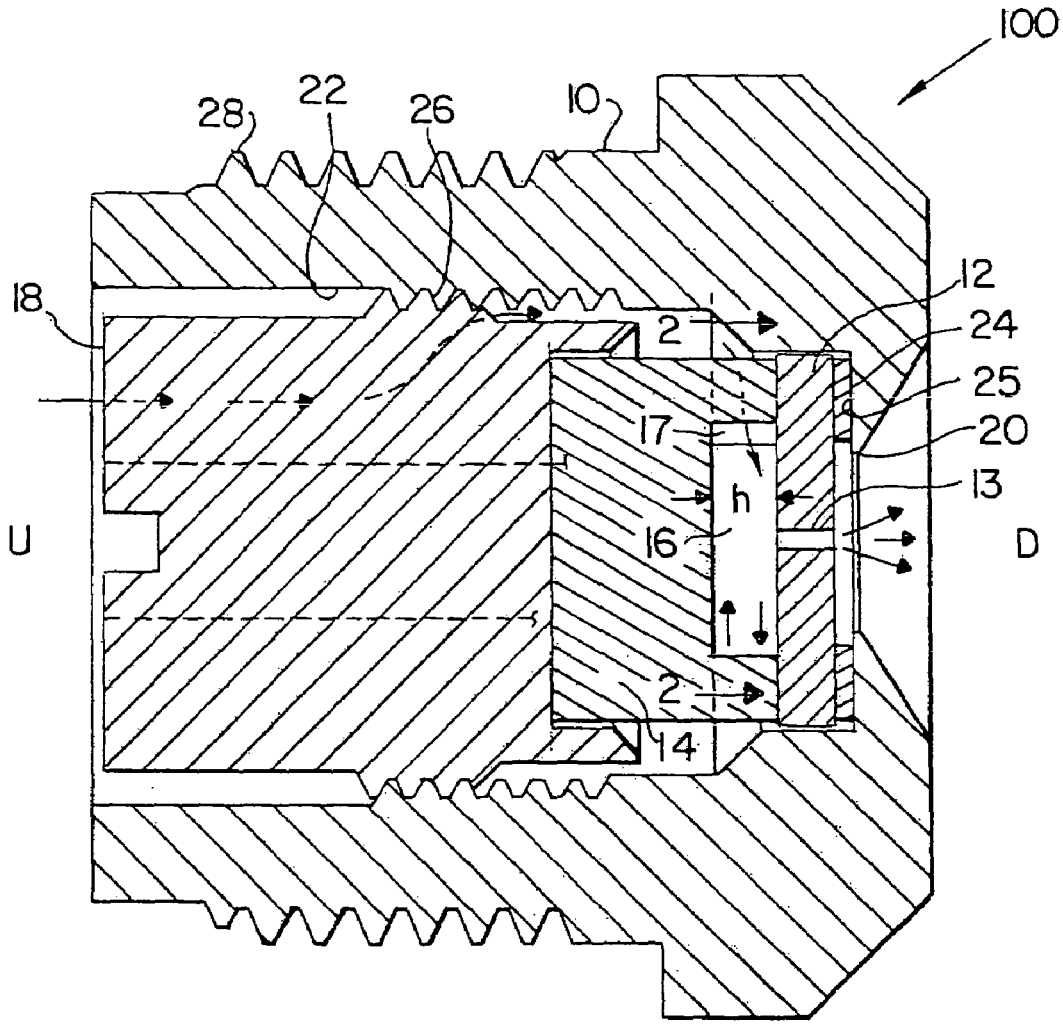
FIG. 1 is a cross-sectional view of a prior art spray nozzle assembly which includes a swirl chamber and an orifice disc that are secured within a nozzle body by a screw pin adapter.
Figure 2:
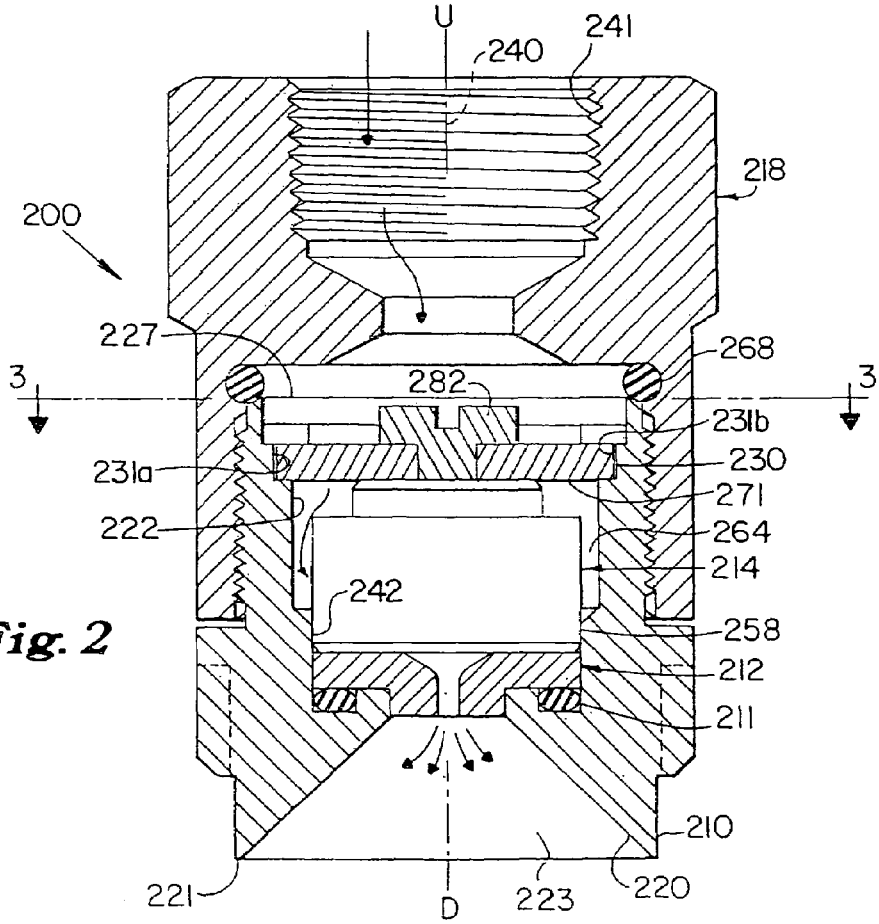
FIG. 2 is a cross-sectional view of a spray nozzle constructed in accordance with a preferred embodiment of the subject invention, wherein an orifice disc and swirl chamber are secured within the nozzle body by a locking plate and are aligned by single internal locating surface.
Figure 4:
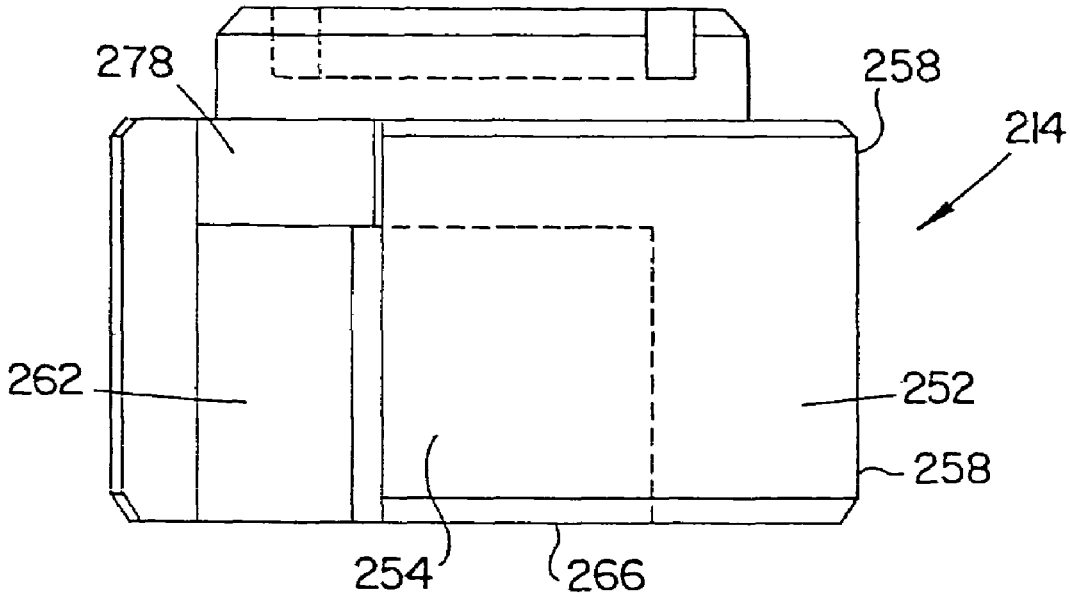
FIG. 4 is an elevational view of the swirl chamber of FIG. 2 which illustrates the inlet passage formed in the peripheral surface of the swirl unit.
Figure 6A:
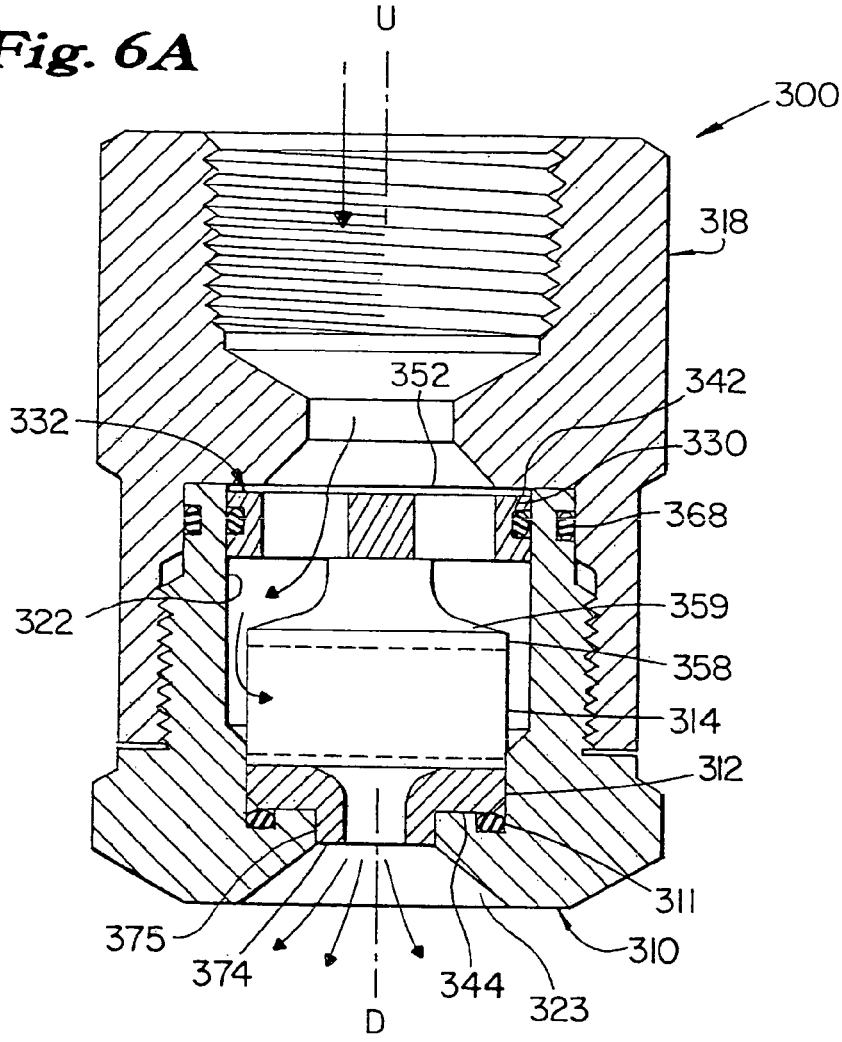
FIG. 6*a* is a cross-sectional view of a spray nozzle constructed in accordance with an alternate embodiment of the subject invention, wherein an orifice disc and swirl element are secured within the nozzle body by a retaining element which includes a retaining disc and seal member.

In the description which follows, as is common in the art to which the subject invention appertains, "upstream side" shall refer to the end of the component which faces the inlet side of the nozzle, while "downstream side" shall refer to the side that faces the discharge orifice of the nozzle. In FIGS. 1, 2 and 6*a* the upstream and downstream ends of the nozzle are identified by reference characters U and D respectively.

Referring now to the drawings wherein like reference numerals identify similar elements of the subject invention, there is illustrated in FIG. 1 a prior art spray nozzle designated generally by reference numeral 100. As shown herein, spray nozzle 100, includes a nozzle body 10, an orifice disc 12, a swirl chamber block member 14, and a retainer member 18 for retaining and positioning the orifice disc 12 and chamber member 14 in the nozzle body 10.

The nozzle body 10 is constructed from stainless steel and includes an opening 20 at the downstream end for the emission of spray from the orifice disc 12 and an elongated passage 22 for receiving the various components of the nozzle. A suitable gasket 24 is preferably disposed between shoulder 25 adjacent to opening 20 and the orifice disc 12. The gasket 24 prevents fluid from leaking around the periphery of orifice disc 12 and between the disc 12 and shoulder 25.

The swirl chamber member 14 has a spiral swirl chamber 16 formed therein with a generally tangential inlet 17. The swirl chamber member 14 is positioned adjacent to the orifice disc 12 such that the downstream side of the swirl chamber 16 communicates with a spray orifice 13 formed in the orifice disc 12, and the upstream side communicates with retainer member 18. Retainer member 18 is preferably cruciform in shape and is engaged with the nozzle body 10 by way of threads 26 to maintain the gasket 24, orifice plate 12, and swirl chamber block member 14 position, as shown in FIG. 1. The exterior of the nozzle body 10 preferably includes threads 28 for receiving a fluid delivery conduit (not shown) which delivers the fluid to be sprayed to the nozzle body 10. The flow path of the fluid through the nozzle 100 is shown by the arrows in FIG. 1, flowing through the cruciform retainer member 18 to the outside of the swirl chamber member 14, where the fluid passes through the tangential inlet 17 of the swirl chamber 16, swirls about the spiral swirl chamber, and exits through the orifice 13 in the plate 12 in the form of a finely atomized spray.

As discussed previously, the flow passages in swirl chamber block member 14 and orifice disc 16 wear due to the flow velocity of the fluid and therefore, must be frequently replaced. However, due to the configuration of spray nozzle 100, reassembling the nozzle is difficult. In order to engage the nozzle body 10, including the orifice disc 12 and the associated O-ring 24, with the adapter 18, either the adapter 18 or the nozzle body 10 must be inverted. The inversion of the adapter 18 or the nozzle body 10 causes the internal components to unseat, become misaligned and often fall out.

Referring now to FIG. 2, there is illustrated a spray nozzle constructed in accordance with a preferred embodiment of the subject invention and designated generally by reference numeral 200. Spray nozzle 200 primarily includes a nozzle body 210, an orifice disc 212, a swirl unit 214, and an adapter member 218. Nozzle body 210 has a central bore 222 formed therein for receiving the orifice disc 212 and the swirl unit 214. Additionally, a discharge portion 220 is provided in downstream nozzle end 221 and defines a spray opening 223 for emitting an atomized spray therefrom. The central bore 222 extends from upstream nozzle end 227 to the discharge portion 220 and defines a central axis 240 for nozzle 200 and interior locating surface 242.

The orifice disc 212 is disposed within the central bore 222 of the nozzle body 210 and is positioned adjacent to the discharge portion 220. An O-ring gasket 211 is provided between the orifice disc 212 and discharge portion 220 of the nozzle body 210. The gasket 211 provides a seal which prevents fluid from leaking around the periphery of the orifice disc 212 and between the orifice disc 212 and discharge portion 220 into spray opening 223.

Figure 5:
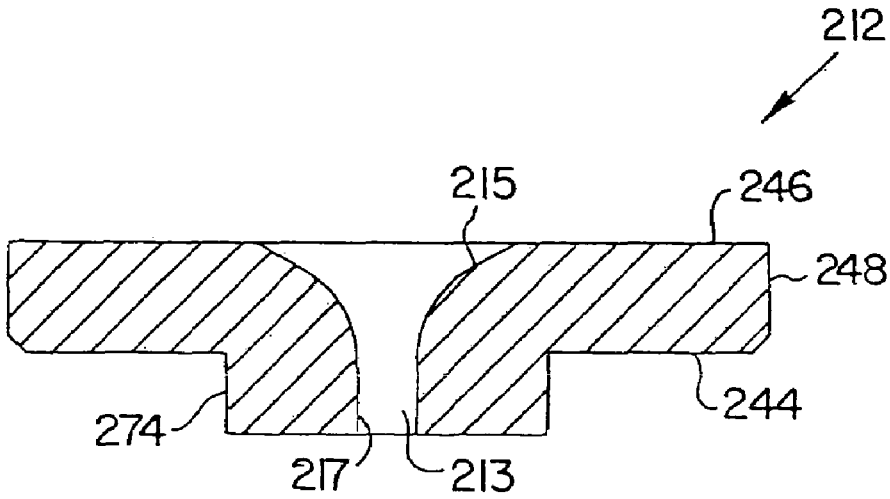
FIG. 5 is a cross-sectional view of the orifice disc of FIG. 2 which illustrates the spray orifice formed therein having a chamfered inlet to centralize the flow.

As shown in FIG. 5, the orifice disc 212 has axially opposed first and second end surfaces, 244 and 246 respectively, and a spray orifice 213 extending therebetween. A peripheral surface 248 extends between end surfaces 244 and 246 and slidably engages with the interior locating surface 242 of the nozzle body 210. The orifice disc 212 also includes a protuberance 274 associated with first end surface 244. The protuberance 274 increases the overall thickness of the orifice disc 212 so as to increase the length of the spray orifice 213. This additional thickness allows for the feed inlet 215 to be chamfered, thus permitting the centralizing of the spray flow while maintaining the straight spray orifice length on the outlet side 217 of the orifice disc. Preferably, orifice disc 212 is constructed from tungsten carbide, chrome carbide or a ceramic material.

With continued reference to FIG. 2, swirl unit 214 is also disposed within the central bore 222 of the nozzle body 210 and is positioned adjacent to orifice disc 212. Preferably, swirl unit 214 is manufactured from tungsten carbide, hardened stainless steel or a ceramic material. The swirl unit 214 has a peripheral surface 252 and a swirl chamber 254 formed therein (FIG. 5). The peripheral surface 252 has a lower portion 256 and upper portion 258. The lower portion 258 of the peripheral surface 252 slidably engages with nozzle body locating surface 242. In contrast to nozzle 100, the axial alignment of the orifice disc 212 and the swirl chamber 214 of nozzle 200 are controlled by a single locating surface 242. The use of a single locating surface for the axial alignment of the swirl unit 214 and the orifice disc 212, ensures that the desired offset of the spray orifice 223 with respect to the swirl origin is achieved. Interior swirl chamber 254 of the swirl unit 214 includes an approximately curvilinear surface which defines a swirl origin (not shown) and has a fluid receiving portion 262 in fluid communication with flow port 264 and a fluid discharge portion 266 in fluid communication with the spray orifice 213 of the orifice disc 212.

In the assembled configuration, the adapter member 218 is threadably engaged with the second end 227 of the nozzle body 210 so as to contain the orifice disc 212 and swirl unit 214 within the bore 222 of the nozzle body 210. An adapter O-ring gasket 268 is disposed between the adapter member 218 and the nozzle body 210 for preventing fluid leakage from the assembled nozzle 200.

Figure 3:
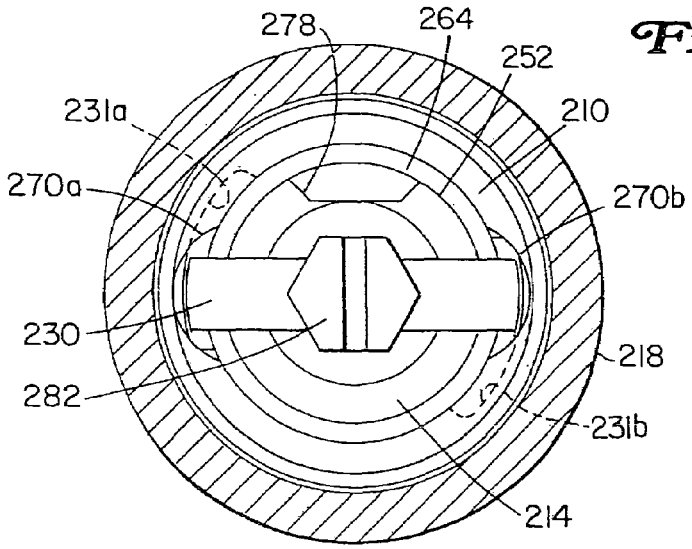
FIG. 3 is a cross-sectional view of the spray nozzle taken along line 3-3 of FIG. 2 and illustrating the fluid inlet formed between the nozzle body and the swirl unit.

Liquid feed flows through nozzle 200 as indicated by the flow arrows. A feed supply conduit (not shown) is engaged with adapter 218 at surface 241. The feed passes through the adapter 218 and enters flow port 264 defined by the space between swirl unit 214 and nozzle body 210. As shown in FIG. 3, swirl unit 214 has a trapezoidal recess 278 formed in peripheral surface 252 for increasing the flow area between the swirl unit and the nozzle body 210. Those skilled in the art will readily appreciate that the depth, quantity and configuration of recess 278 can be selectively adjusted based on the desired nozzle flow characteristics. If flow port 264 is capable of providing a sufficient liquid feed flow rate based on the intended application, recess 278 may not be required. Alternatively, a recess could be formed in nozzle body 210 in stead of swirl unit 214.

The liquid feed enters the swirl chamber 254 of the swirl unit 214 through fluid receiving portion 262 and a spiral motion is imparted thereon as known to those skilled in the art. The feed then exits the swirl chamber 254 through discharge portion 266 and is atomized by spray orifice 213. Atomized feed exits spray orifice 213 and spray opening 223 of the nozzle body 210.

With continuing reference to FIG. 2, spray nozzle 200 further includes a locking plate 230 which is engaged with corresponding recesses 231*a* and 231*b* which are formed in nozzle body 210. As discussed previously, reassembling a spray nozzle is complicated by the inability to properly maintain the alignment and positioning of the internal components when the nozzle body is being engaged with the adapter. Locking plate 230 provides a mechanism for positively securing the orifice disc 212 and swirl unit 214 in place and compressing the orifice O-ring gasket 211 prior to threadably engaging the nozzle body 210 with the adapter 218. The locking plate 230 is preferably manufactured from a suitable wear resistant material, such as for example tungsten carbide or a ceramic material.

After the gasket 211, orifice disc 212 and swirl unit 214 are positioned within the bore 222, locking plate 230 is installed through access segment cuts 270*a* and 270*b* provided in the nozzle body using a suitable fixing tool. When face 271 of locking plate 230 contacts the recesses 231*a* and 231*b* of the nozzle body 210, locking plate 230 is rotated clockwise into the recesses until the fully locked position is reached. The assembly, which includes the nozzle body 210, swirl unit 214, orifice O-ring gasket 211 and orifice disc 212 is thereupon a fixed unit and is ready for engagement with the adapter.

The locking plate 230 also includes a tool receiving portion 282 for facilitating the rotational engagement of the locking plate 230 with the nozzle body 210. The locking plate, in addition to securing the internal components within the nozzle body, provides a mechanism for ensuring that O-ring gasket 211 is properly compressed and a fluid tight seal is established between the orifice disc 212 and the discharge portion 220 of the nozzle body 210. This is achieved by selectively positioning the recesses 231*a* and 231*b* with respect to the second end 227 of the nozzle body 210 such that the desired compression is obtained. It should be noted that recesses 231*a* and 231*b* are formed such that they are positioned in a plane extending through central axis 240 at a right angle. Alternatively, the recesses could be formed in a plane which intersects the central axis 240 at an acute angle, and therefore, the rotational manipulation of locking plate 230 increases or decreases the compression of O-ring gasket 211.

Referring now to FIG. 6*a*, there is illustrated a spray nozzle constructed in accordance with an alternate embodiment of the subject invention and designated by reference numeral 300. Similar to spray nozzle 200, spray nozzle 300 includes a nozzle body 310, an orifice disc 312, a swirl unit 314, and an adapter member 318. However, in contrast to spray nozzle 200, spray nozzle 300 further includes a retainer element 330.

Figure 6B:
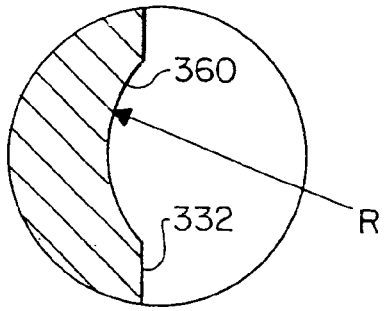
FIG. 6*b* is a partially exploded view of the nozzle body of FIG. 6*a* illustrating the recess formed in the central bore for receiving the seal member of the retainer element.
Figure 7A:
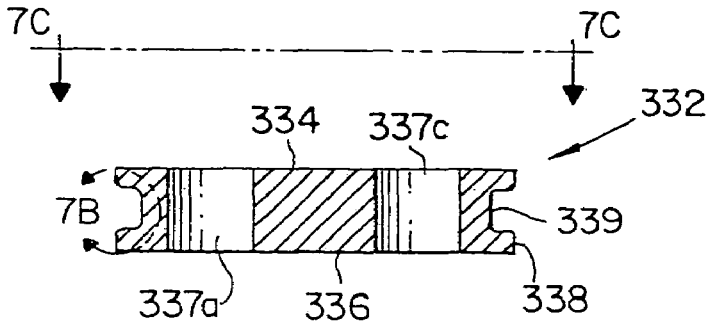
FIG. 7*a* is a cross-sectional view of the retainer disc which illustrates a groove formed in the periphery of the disc for receiving a seal member.
Figure 7B:
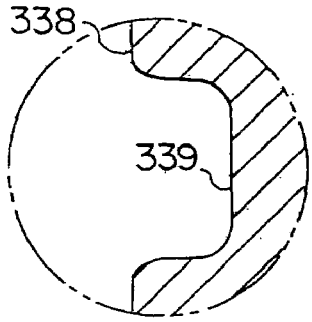
FIG. 7*b* is a partially exploded view of the groove formed in the retainer disc of FIG. 7*a*.
Figure 7C:
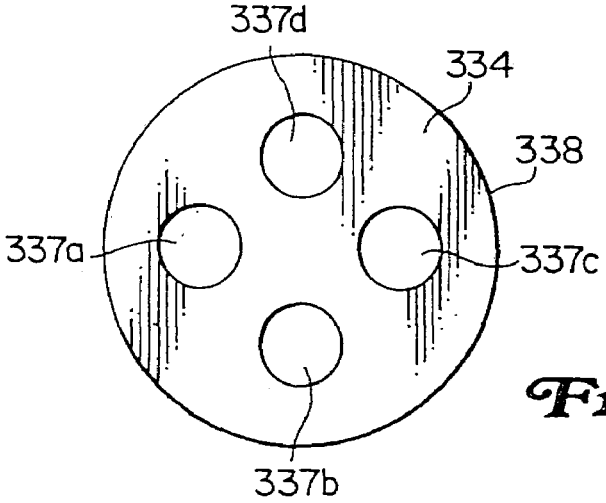
FIG. 7*c* is a top plan view of the retainer disc of FIG. 7*a* which illustrates four flow apertures formed in the disc.

Retainer element 330 is disposed within the central bore 322 of nozzle body 310 and is positioned upstream of swirl element 314. The retainer element 330 includes a retainer disc 332 and a seal member 342. As shown in FIGS. 7*a*-7*c*, the retainer disc 332 has opposed upstream and downstream planar surfaces, 334 and 336 respectively, and a peripheral surface 338 extending therebetween. A groove 339 is formed in peripheral surface 338 for receiving seal member 342. As shown in FIG. 6*a*, seal member 342 is engaged within a corresponding recess 360 formed in the central bore 322 of the nozzle body 310 so as to secure the retainer element 330, swirl element 314, and orifice disc 312 within the central bore 322. FIG. 6*b* illustrates the configuration of the recess 360 formed in central bore 322 which has a radius "R".

Retainer element 330 functions similar to that of locking plate 230 in that it facilitates the reassembling of nozzle 300. Retainer element 330 provides a mechanism for positively securing the orifice disc 312 and swirl unit 314 in place and compressing the orifice O-ring gasket 311 prior to threadably engaging the nozzle body 310 with the adapter 318. After the O-ring gasket 311, orifice disc 312 and swirl element 314 are positioned with the central bore 322, the retainer element 330 is inserted into the central bore 322 until the seal member 342 engages with recess 360. Recess 360 is positioned such that proper compression is applied to O-ring gasket 311.

With continued reference to FIG. 6*a*, orifice disc 312 is similar in configuration to orifice disc 212 illustrated in FIG. 5. However, the protuberance 374 associated with the downstream surface 344 of orifice disc 312 has a chamfered downstream edge 375. Chamfered edge 375 facilitates the insertion of the protuberance 374 into the spray opening 323 of the nozzle body 310 and the alignment of the orifice disc 312.

In contrast to swirl element 214 of FIG. 2, swirl element 314 includes a tapered neck portion 359 associated with an upstream end 358 thereof. The tapered neck portion 359 facilitates the flow of fluid through nozzle 300 by providing a smoother transition for the flow from the nozzle body inlet region 352 to the swirl inlet (not shown). In addition, flow apertures 337*a*-337*d* (FIG. 7*c*) are provided in retainer disc 332 and further facilitate fluid communication through valve 300. Those skilled in the art would readily appreciate that the quantity, shape and size of the flow apertures can vary depending on the desired flow characteristics for spray nozzle 300. The tapered neck portion 359 of the swirl element 314 and the flow apertures 337*a*-337*d* prevent blockages from being formed within nozzle 300 and reduce the pressure loss across the nozzle.

Those skilled in the art will readily appreciate that various materials can be used for the construction of the spray nozzle components disclosed herein. Spray nozzle wear largely depends upon its corrosion and erosion resistance. Corrosion occurs when the liquid feed and nozzle component material are chemically incompatible. Erosion results from the liquid feed with its abrasive solids passing through the flow passages at high velocities and physically removing component material. Corrosion problems can often be avoided or at least greatly reduced by determining the chemical characteristics of the liquid feed. Various materials can then be used based upon their ability to resists chemical and physical attack. Material possibilities are too numerous to list, but the materials disclosed herein are intended for illustrative purposes only and are not intended to limit the scope of the disclosure.

While the invention has been described with respect to preferred embodiments, those skilled in the art will readily appreciate that various changes and/or modifications can be made to the invention with departing from the spirit or scope of the invention as defined by the appended claims.

What is claimed is:

1. A spray nozzle comprising:

a) a nozzle body having opposed upstream and downstream end portions, the upstream end portion including a fluid receiving section, the downstream end portion including a fluid discharge section and defining a spray opening for emitting an atomized spray therefrom, the nozzle body defining a central bore which extends between the fluid receiving section and the fluid discharge section and delineates a central axis and delimits an interior locating surface for the nozzle;

b) a swirl element disposed within the central bore of the nozzle body and positioned adjacent to the fluid receiving section of the nozzle body, the swirl element having a peripheral surface and defining an interior swirl cavity, the peripheral surface having an upstream and a downstream portion, the downstream portion being configured for slidable engagement with the interior locating surface of the nozzle body, the upstream portion having a fluid inlet formed therein to provide fluid communication between the fluid receiving section of the nozzle body and the interior swirl cavity of the swirl element, the interior swirl cavity being defined by an approximately curvilinear surface for imparting a spiral flow to the fluid passing therethrough and including a fluid outlet for discharging the spiral flow therefrom; and c) an orifice disc disposed within the central bore of the nozzle body and positioned upstream of the fluid discharge section of the nozzle body, the orifice disc including axially opposed upstream and downstream surfaces defining a peripheral surface therebetween which is configured for slidable engagement with the interior locating surface of the nozzle body, the orifice disc further including a spray orifice that extends between the opposed upstream and downstream surfaces and is in fluid communication with the fluid outlet of the swirl cavity and the discharge section of the nozzle body, the spray orifice emitting the spiral flow in an atomized manner; and d) locking means disposed within the central bore of the nozzle body and positioned upstream of the swirl element for holding the swirl element and the orifice disc in place, wherein the locking means includes two radially opposed recesses formed in the central bore of the nozzle body and a locking plate which is rotatably engaged within the radially opposed recesses formed in the central bore of the nozzle body.

2. A spray nozzle as recited in claim 1, further comprising an adapter member engaged with the upstream end portion of the nozzle body so as to contain the orifice disc and swirl element within the bore of the nozzle body.

3. A spray nozzle as recited in claim 2, wherein the upstream end portion of the nozzle body has male threads associated therewith for engagement with corresponding female threads associated with the adapter member.

4. A spray nozzle as recited in claim 1, wherein the central bore of the nozzle body further includes a second interior surface which is positioned radially outward of the interior locating surface for facilitating flow between the upstream portion of the swirl element peripheral surface and the nozzle body.

5. A spray nozzle as recited in claim 1, wherein the recesses are angled with respect to a plane passing through and perpendicular to the central axis such that the rotational engagement of the locking plate increases a contact pressure applied by the locking plate to the swirl element.

6. A spray nozzle as recited in claim 1, wherein the locking plate includes tool engaging means for facilitating the rotational engagement of the locking plate with the recesses formed in the central bore.

7. A spray nozzle as recited in claim 1, wherein the orifice disc has a protuberance associated with the downstream surface thereof which protrudes into the spray opening of the nozzle body.

8. A spray nozzle as recited in claim 7, wherein the protuberance associated with the downstream surface of the orifice disc has a chamfered downstream edge for facilitating insertion of the protuberance into the spray opening of the nozzle body.

9. A spray nozzle as recited in claim 1, wherein the swirl element further includes a recessed surface formed in the upstream portion of the peripheral surface for facilitating fluid flow between the upstream portion of the peripheral surface and the nozzle body.

10. A spray nozzle as recited in claim 9, wherein the recessed surface formed in the upstream portion of the peripheral surface of the swirl element has a trapezoidal axial cross-section.

11. A spray nozzle as recited in claim 1, wherein the swirl element further includes a tapered neck portion associated with an upstream end thereof.

12. A spray nozzle as recited in claim 1, wherein a gasket is provided between the orifice disc and the discharge portion of the nozzle body and the locking plate is adapted to secure the orifice disc and swirl element in place while compressing the gasket.

13. An orifice disc for a spray nozzle, wherein the spray nozzle includes opposed upstream and downstream end portions, the upstream end portion including a fluid receiving section, the downstream end portion including a fluid discharge section and defining a spray opening for emitting a spray therefrom, the nozzle body defining a central bore which extends between the fluid receiving section and the fluid discharge section and delineates a central axis and delimits an interior locating surface for the orifice disc, the orifice disc comprising:

axially opposed upstream and downstream surfaces defining a peripheral surface therebetween which is configured for slidable engagement with the interior locating surface of the nozzle body, the orifice disc further including a spray orifice that extends between the opposed upstream and downstream surfaces, and includes a straight length portion on the outlet side of the orifice disc, the downstream surface having a protuberance formed thereon for increasing the axial length of the spray orifice, wherein the protuberance associated with the downstream surface of the orifice disc has a beveled downstream edge for facilitating insertion of the protuberance into the spray opening of the nozzle body, and wherein the spray orifice of the orifice disc includes a tapered inlet formed in the upstream surface of the orifice disc so as to centrally direct fluid provided thereto, wherein the tapered inlet is chamfered and includes a curved surface to form a continuous curved transition into the straight length portion of the spray orifice.

14. An orifice disc as recited in claim 13, wherein the protuberance has a cross-section with an outside diameter decreasing in the direction from upstream to downstream.

15. An orifice disc as recited in claim 13, wherein the orifice disc includes a material selected from the group consisting of tungsten carbide, chrome carbide, and a ceramic material.

16. A spray nozzle comprising:

a) a nozzle body having opposed upstream and downstream end portions, the upstream end portion including a fluid receiving section, the downstream end portion including a fluid discharge section and defining a spray opening for emitting a spray therefrom, the nozzle body defining a central bore which extends between the fluid receiving section and the fluid discharge section and delineates a central axis and delimits at least one interior locating surface for the nozzle;

b) a swirl element disposed within the central bore of the nozzle body and positioned adjacent to the fluid receiving section of the nozzle body, the swirl element having a peripheral surface and defining an interior swirl cavity, the peripheral surface having an upstream and a downstream portion, the downstream portion being configured for slidable engagement with the at least one interior locating surface of the nozzle body, the upstream portion having a fluid inlet formed therein to provide fluid communication between the fluid receiving section of the nozzle body and the interior swirl cavity of the swirl element, the interior swirl cavity being defined by an approximately curvilinear surface for imparting a spiral flow to the fluid passing therethrough and including a fluid outlet for discharging the spiral flow therefrom;

c) an orifice disc disposed within the central bore of the nozzle body and positioned upstream of the fluid discharge section of the nozzle body, the orifice disc including axially opposed upstream and downstream surfaces defining a peripheral surface therebetween which is configured for slidable engagement with the at least one interior locating surface of the nozzle body, the orifice disc further including a spray orifice that extends between the opposed upstream and downstream surfaces and is in fluid communication with the fluid outlet of the swirl cavity and the discharge section of the nozzle body, the spray orifice emitting the spiral flow in an atomized manner; and d) locking means disposed within the central bore of the nozzle body and positioned upstream of the swirl element for holding the swirl element and the orifice disc in place, wherein the central bore has at least one groove formed therein in a plane perpendicular to the central axis of the central bore, and wherein the locking means is engaged with the at least one groove formed in the central bore of the nozzle body.

17. A spray nozzle as recited in claim 16, further comprising an adapter member fixably engaged with the upstream end portion of the nozzle body so as to enclose the orifice disc and the swirl element within the central bore of the nozzle body.

18. A spray nozzle as recited in claim 17, wherein the upstream end portion of the nozzle body has male threads associated therewith for engaging with corresponding female threads associated with the adapter member.

19. A spray nozzle as recited in claim 16, wherein the at least one interior locating surface of the central bore includes a first and a second interior locating surface, wherein the second interior surface is positioned upstream and radially outward of the first interior locating surface for facilitating flow between the upstream portion of the swirl element peripheral surface and the nozzle body.

20. A spray nozzle as recited in claim 16, wherein the locking means includes a locking plate disposed within the central bore of the nozzle body and positioned upstream of the swirl element, the locking plate being rotatably engaged within the at least one groove formed in the central bore of the nozzle body.

21. A spray nozzle as recited in claim 16, wherein the locking means includes a retainer element disposed within the central bore of the nozzle body and positioned upstream of the swirl element, the retaining element comprising:

a) a retainer disc having opposed upstream and downstream planar surfaces and a peripheral surface extending therebetween, the peripheral surface having a recess formed therein; and b) a seal member disposed within the recess formed in the peripheral surface of the retainer disc, the seal member engaging with the at least one groove formed in the central bore of the nozzle body.

22. A spray nozzle as recited in claim 16, wherein the locking means includes tool engaging means for facilitating the rotational engagement of the locking means with the at least one groove formed in the central bore of the nozzle body.

23. A spray nozzle as recited in claim 16, wherein the orifice disc has a protuberance associated with the downstream surface thereof which protrudes into the spray opening of the nozzle body.

24. A spray nozzle as recited in claim 16, wherein the swirl element further includes a recessed surface formed in the upstream portion of the peripheral surface for facilitating fluid flow between the upstream portion of the peripheral surface and the nozzle body.

25. A spray nozzle as recited in claim 24, wherein the recessed surface formed in the upstream portion of the peripheral surface of the swirl element has a trapezoidal axial cross-section.

26. A spray nozzle as recited in claim 16, wherein the locking means is formed integral with the swirl element.

27. A spray nozzle as recited in claim 16, wherein the locking means comprises tabs formed on the upstream portion of the peripheral surface for engaging with the at least one groove formed in the central bore of the nozzle body.

28. A spray nozzle as recited in claim 16, wherein the swirl element further includes a tapered neck portion associated with an upstream end thereof.

29. A spray nozzle as recited in claim 16, wherein a gasket is provided between the orifice disc and the discharge portion of the nozzle body and the locking means when engaging the groove is adapted to secure the orifice disc and swirl element in place while compressing the gasket.

30. A spray nozzle comprising:

a) a nozzle body having opposed upstream and downstream end portions, the upstream end portion including a fluid receiving section, the downstream end portion including a fluid discharge section and defining a spray opening for emitting a spray therefrom, the nozzle body defining a central bore which extends between the fluid receiving section and the fluid discharge section and delineates a central axis and delimits at least one interior locating surface for the nozzle, the central bore having at least one groove formed therein;

b) a swirl element disposed within the central bore of the nozzle body and positioned adjacent to the fluid receiving section of the nozzle body, the swirl element having a peripheral surface and defining an interior swirl cavity, the peripheral surface having an upstream and a downstream portion, the downstream portion being configured for slidable engagement with the at least one interior locating surface of the nozzle body, the upstream portion having a fluid inlet formed therein to provide fluid communication between the fluid receiving section of the nozzle body and the interior swirl cavity of the swirl element, the interior swirl cavity being defined by an approximately curvilinear surface for imparting a spiral flow to the fluid passing therethrough and including a fluid outlet for discharging the spiral flow therefrom;

c) an orifice disc disposed within the central bore of the nozzle body and positioned upstream of the fluid discharge section of the nozzle body, the orifice disc including axially opposed upstream and downstream surfaces defining a peripheral surface therebetween which is configured for slidable engagement with the at least one interior locating surface of the nozzle body, the orifice disc further including a spray orifice that extends between the opposed upstream and downstream surfaces and is in fluid communication with the fluid outlet of the swirl cavity and the discharge section of the nozzle body, the spray orifice emitting the spiral flow in an atomized manner; and d) locking means disposed within the central bore of the nozzle body and positioned upstream of the swirl element, the locking means engaged with the at least one groove formed in the central bore of the nozzle body, wherein the locking means includes a retainer element disposed within the central bore of the nozzle body and positioned upstream of the swirl element, the retaining element including:

i) a retainer disc having opposed upstream and downstream planar surfaces and a peripheral surface extending therebetween, the peripheral surface having a recess formed therein; and ii) a seal member disposed within the recess formed in the peripheral surface of the retainer disc, the seal member engaging with the at least one groove formed in the central bore of the nozzle body.

* * * * *